United States Patent [19]

Lunt

[11] Patent Number: 5,052,195

[45] Date of Patent: Oct. 1, 1991

[54] COIN HOLDER AND METHOD THEREFOR

[76] Inventor: Dean E. Lunt, 1049 W. 7th St., Mesa, Ariz. 85201

[21] Appl. No.: 514,313

[22] Filed: Apr. 25, 1990

[51] Int. Cl.[5] ..... A44C 11/00

[52] U.S. Cl. ..... 63/21; 63/24; 63/29.1

[58] Field of Search ..... 206/0.8, 0.81, 0.82, 206/0.83; 24/3 R, 3 F, 3 J, 3 K, 460, 462, 573.1, 573.7; 40/1.6, 323, 27.5; 63/21, 1.1, 2, 23, 24, 25, 29.1

[56] References Cited

U.S. PATENT DOCUMENTS

| | | | |
|---|---|---|---|
| 996,678 | 7/1911 | Reynolds | 63/29.1 |
| 1,113,011 | 10/1914 | Lahn | 63/24 X |
| 1,130,381 | 3/1915 | Cunningham | 63/29.1 X |
| 2,598,029 | 5/1952 | Baldwin | 24/3 J X |
| 3,115,758 | 12/1963 | Eberle | 63/29.1 X |

FOREIGN PATENT DOCUMENTS

| | | | |
|---|---|---|---|
| 2431266 | 3/1980 | France | 63/29.1 |
| 193 | of 1905 | United Kingdom | 63/24 |
| 12008 | of 1909 | United Kingdom | 63/21 |

*Primary Examiner*—Laurie K. Cranmer

*Attorney, Agent, or Firm*—Harry M. Weiss; Antonio R. Durando

[57] ABSTRACT

A coin holder for use in holding a coin, or the like. The coin holder includes a lower clamp and an upper clamp and a resilient U-shaped pin. Each clamp has a pair of aligned tubes for receiving a respective leg portion of pin. Each clamp has opposite diagonal end portions with hook tabs which hook over a pair of peripherally spaced coin edge portions. A loop is provided to connect the coin holder to a necklace or bracelet.

5 Claims, 1 Drawing Sheet

COIN HOLDER AND METHOD THEREFOR

This invention generally relates to a coin holder and method therefore, and, in particular, the invention relates to a coin holder and method therefor having a pair of clamps with a connector pin.

BACKGROUND OF THE INVENTION

One type of prior art coin holder is described, for example, in U.S. Pat. No. 2,358,262, issued Sept. 12, 1944. Related patents include U.S. Pat. Nos. 417,016, issued Dec. 10, 1889, 1,113,034, issued Oct. 6, 1914, 1,473,273, issued Nov. 6, 1923, 1,849,001, issued Mar. 8, 1932, and 3,335,786, issued Aug. 15, 1967.

The prior art type of coin holder disclosed in U.S. Pat. No. 2,358,262 includes a two-piece hinged circular casing for a coin and an attached barbell-shaped bent wire for a currency bill.

One problem with this prior art coin holder is that it is both difficult and very costly to make the two-piece hinged casing. Also, prior art type devices use threaded aperture members and corresponding screw type members for coupling thereto wherein the threads of the aperture members or the screw type members become worn with use thereby causing failure of the prior art attaching mechanisms.

SUMMARY OF THE INVENTION

According to the present invention, a coin holder is provided. This coin holder, for a coin having a front face and a rear face and a circular edge, comprises a first clamp having a pair of hook portions hooked over and in contact with a first pair of spaced portions of the coin circular edge, and a second clamp having a pair of hook portions hooked over and in contact with a second pair of spaced portions of the coin circular edge, and a pin member means having a first leg portion for connecting to the first clamp and a second leg portion for connecting to the second clamp. Preferably the pin member means is somewhat resilient and has a hairpin-shaped configuration.

By using the first clamp and second clamp and connecting pin, the difficulty and expense of making a reliable, sturdy and easy to use coin holder is significantly and substantially minimized.

The foregoing and other objects, features and advantages will be apparent from the following description of the preferred embodiment of the invention as illustrated in the accompanying drawings.

DESCRIPTION OF THE PREFERRED EMBODIMENT

Figure 1:
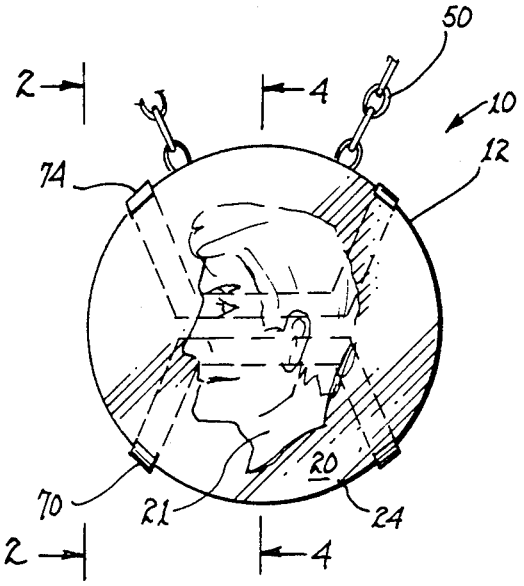
FIG. 1 is an elevation front view of a coin holder according to the invention.
Figure 3:
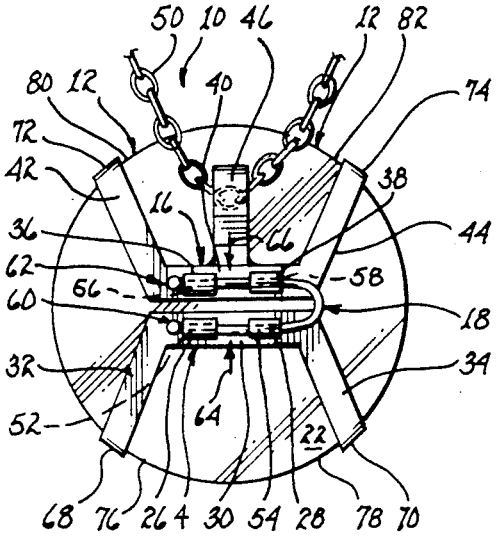
FIG. 3 is an elevation back view of the coin holder of this invention as along line 3—3 of FIG. 2.
Figure 2:
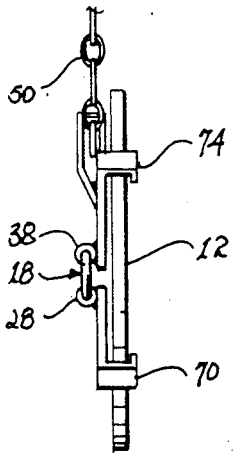
FIG. 2 is an elevation side view as taken along line 2—2 of FIG. 1.
Figure 4:
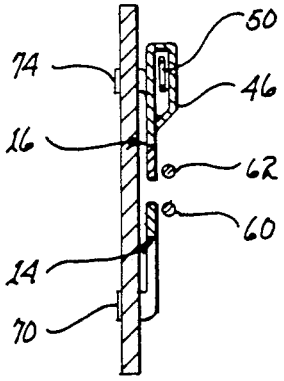
FIG. 4 is a section view as taken along line 4—4 of FIG. 1.

As shown in FIGS. 1,2,3,and 4, a coin holder 10, which is used to hold a coin 12, or the like, is provided. Coin holder 10 has a lower clamp 14, an upper clamp 16, and a substantially U-shaped tension spring member or hairpin-shaped connector pin 18. Coin 12 has a front face 20 and a rear face 22 and a circular edge portion 24. Front face 20 has an identification emblem 21, or the like.

Lower clamp 14 has a left tube 26 and a right tube 28, which are fixedly connected thereto. Lower clamp 14 has a center horizontal portion 30, a left diagonal portion 32, and a right diagonal portion 34.

Figure 5:
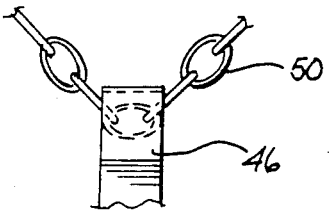
FIG. 5 is a side elevation view showing the coupling of the claim to the loop that is attached to the coin holder of this invention.
Figure 6:
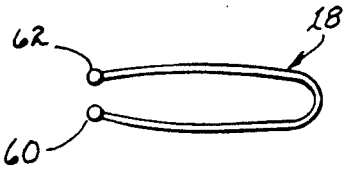
FIG. 6 is a side elevation view showing the connector pin with its inwardly biased end portions used to provide a more positive compressive clamping force on the two clamps coupled thereto.

Upper clamp 16 has a left tube 36 and a right tube 38, which are fixedly connected thereto. Upper clamp 16 also has a center horizontal portion 40, a left diagonal portion 42, and a right diagonal portion 44. Preferably, center horizontal portion 40 has a loop 46, which is fixedly connected thereto. The loop 46 is used to permit the coin holder to be used with a necklace chain or, if desired, with a bracelet chain. Therefore, a chain 50, such as a necklace or bracelet type chain will pass through the loop 46 which is thereby coupled thereto. FIG. 5 shows the preferred way that the chain 50 passes through the loop 46. Tubes 26, 28, 36, 38, which are identical, have respected holes 52, 54, 56, 58.

Pin 18 has a lower leg portion 60, which extends through holes 52, 54; and has an upper leg portion 62, which extends through holes 56, 58. Preferably, both the upper and lower leg portions 62 and 60, respectively, have rounded end portions for ease of finger gripping. These rounded end portions can pass through the tubes 26, 28, 36, and 38. Preferably, the ends of the lower and upper leg portions 60 and 62 with their rounded end portions are biased inwardly towards each other to provide a compressive force to better hold together the tubes 26, 28, 36 and 38 thereby providing a more secure clamping action. Therefore, lower leg 60 applies a compressive force 64, and upper leg 62 applies an opposite downward compressive force 66, when legs 60, 62 are moved or spring apart. When coin holder 10 is assembled, legs 60, 62 are normally about parallel, and, because of the biasing of the end portions, provide the compressive forces 64, 66. Legs 60, 62 normally have a very slight frictional engagement with their respective tubes 26, 28 and 36, 38 for holding pin 18 in place.

Diagonal portions 32, 34, 42, 44 have respective end hook portions or tabs 68, 70, 72, 74 which hook over respective spaced parts 76, 78, 80, 82 of edge 24.

A preferred method of manufacture includes positioning hook portions 68, 70, 72, 74 over edge parts 76, 78, 80, 82; then holding clamp 14, 16 together; and then sliding pin 18 through tube holes 52, 54, 56, 58.

While the invention has been described in its preferred embodiment, it is to be understood that the words which have been used are words of description rather than limitation and that changes may be made within the purview of the appended claims without departing from the true scope and spirit of the invention in its broader aspects. For example, two longer tubes can be used in place of four tubes 26, 28, 36, 38. As another example, other forms of connections can be used in place of chain 50 and loop 46.

What is claimed:

1. A coin and holder combination, comprising:

a coin having a front face and a rear face and an edge portion;

a first clamp;

a second clamp; and pin member means, comprising a U-shaped pin having a first leg portion for connecting to said first clamp and having a second leg portion for connecting to said second clamp, whereby said first and second clamps form a holding frame for said coin.

2. The coin and holder combination of claim 1 wherein said U-shaped pin is resilient.

3. A coin and holder combination, comprising:

a coin having a front face and a rear face and an edge portion;

a first clamp;

a second clamp; and pin member means having a first leg portion for connection to said first clamp and having a second leg portion for connecting to said second clamp, whereby said first and second clamps form a holding frame for said coin;

wherein said first clamp has a pair of connectors having respective aligned holes receiving said first leg portion and said second clamp has a pair of connectors having respective aligned holes receiving said second leg portion; wherein each of said first and secodn clamps has a center portion having opposite end diagonal portions with respective hook portions hooking over peripherally spaced parts of said coin edge portion; and wherein said pin member means is composed of a spring type material having inwardly biased end portions so that each of said leg portions applies a diametrically opposite compressive force on said pairs of connectors of each of said clamps.

4. A method of manufacture of a coin and holder combination having a coin with spaced edge portions including athe steps of:

forming first and second clamps each having at least one tube and having opposite end diagonal portions with respective hook portions;

positioning said hook portions over said coin edge portions;

holding said clamps together as positioned;

forming a U-shaped pin having a pair of leg portions; and sliding each leg portion through said at least one tube of said first and second clamps.

5. The method of claim 4, wherein each of said first and second clamps has a pair of said tubes, and each of said pin's leg portions is slid through a respective pair of said tubes.

* * * * *